US010590625B2

(12) United States Patent
Burnette et al.

(10) Patent No.: US 10,590,625 B2
(45) Date of Patent: Mar. 17, 2020

(54) REAR FRAME FOR A MOTOR GRADER

(71) Applicant: Caterpillar Inc., Deerfield, IL (US)

(72) Inventors: Matthew Graham Burnette, Decatur, IL (US); Jesse Gerald Grant Fair, Monticello, IL (US); Jeremy Wright, Monticello, IL (US); Bruce Raymond Vahling, Urbana, IL (US); Nikhil Sharma, Forsyth, IL (US)

(73) Assignee: Caterpillar Inc., Peoria, IL (US)

( * ) Notice: Subject to any disclaimer, the term of this patent is extended or adjusted under 35 U.S.C. 154(b) by 80 days.

(21) Appl. No.: 16/028,524

(22) Filed: Jul. 6, 2018

(65) Prior Publication Data

US 2020/0011026 A1 Jan. 9, 2020

(51) Int. Cl.

| | |
|---|---|
| ***E02F 9/08*** | (2006.01) |
| ***E02F 3/76*** | (2006.01) |
| ***E02F 3/96*** | (2006.01) |

(52) U.S. Cl.

CPC ..... *E02F 9/0816* (2013.01); *E02F 3/7604* (2013.01); *E02F 3/961* (2013.01); *E02F 3/764* (2013.01); *E02F 3/7645* (2013.01); *E02F 9/0841* (2013.01)

(58) Field of Classification Search

CPC ..... E02F 9/0816; E02F 3/7604; E02F 3/961; E02F 3/764; E02F 3/7645; E02F 9/0841

See application file for complete search history.

(56) References Cited

U.S. PATENT DOCUMENTS

| | | | | |
|---|---|---|---|---|
| 3,973,632 | A | 8/1976 | Torazzi | |
| 4,229,044 | A | 10/1980 | Cobb et al. | |
| 4,351,397 | A | 9/1982 | Winker | |
| 6,719,075 | B2 | 4/2004 | Kamikawa | |
| 7,401,673 | B2 | 7/2008 | Fukazawa et al. | |
| 7,445,053 | B2 | 11/2008 | Matsumoto et al. | |
| 7,841,423 | B2 | 11/2010 | Damm et al. | |
| 8,393,429 | B2 | 3/2013 | Thomson et al. | |
| 8,899,371 | B2 | 12/2014 | Uno et al. | |
| 8,950,535 | B2 | 2/2015 | Harada et al. | |
| 8,985,233 | B2 * | 3/2015 | Padilla | E02F 3/764 172/4.5 |
| 9,255,379 | B2 * | 2/2016 | Yoshimura | E02F 3/764 |
| 9,267,268 | B2 * | 2/2016 | Arai | B60K 15/063 |
| 9,540,787 | B2 * | 1/2017 | West | E02F 3/847 |

(Continued)

FOREIGN PATENT DOCUMENTS

WO 8200076 1/1982

*Primary Examiner* — Lori L Lyjak

(57) ABSTRACT

A rear frame for a motor grader includes a pair of arms that are disposed equidistantly from a mid-plane. Each arm has a front portion, a rear portion, and a mid-portion located between the front and rear portions. The front portion of each arm is configured to pivotally couple with a front frame of the motor grader. The rear frame also includes a ripper mounting arrangement, a bumper, and a torque resisting member. The ripper mounting arrangement is located at a rear end of the rear portion of each arm. The bumper is laterally disposed with respect to the mid-plane and rigidly attached to a position on the rear portion of each arm located adjacent the rear end of the rear portion of each arm. The torque resisting member is laterally disposed with respect to the mid-plane and rigidly attached to the mid-portion of each arm.

20 Claims, 5 Drawing Sheets

(56) References Cited

U.S. PATENT DOCUMENTS

| | | | | |
|---|---|---|---|---|
| 10,316,491 | B2 * | 6/2019 | Gentle | E02F 3/844 |
| 2008/0245540 | A1 * | 10/2008 | Shekleton | E02F 3/627<br>172/789 |
| 2013/0161036 | A1 * | 6/2013 | Polumati | E02F 5/32<br>172/663 |
| 2015/0152623 | A1 * | 6/2015 | Yamazaki | E02F 3/80<br>172/663 |

* cited by examiner

REAR FRAME FOR A MOTOR GRADER

TECHNICAL FIELD

The present disclosure relates to a motor grader. More particularly, the present disclosure relates to a rear frame of a motor grader that is adapted for directly mounting an attachment thereto.

BACKGROUND

Typically, a motor grader would include a frame that would support various components, for example, an engine, a transmission, or other components thereon. In some cases, other attachments such as an assembly of rippers would need to be additionally mounted onto the frame for use during operation of the motor grader. In such cases, an adapter would be provided in between the frame and the attachment such that the adapter would be mounted to the frame and this mounted adapter would then facilitate a connection of the attachment with the frame. Such use of the adapter in mounting the attachment to the frame of the motor grader could render a resulting configuration of parts associated with the mounting of the attachment to the frame to become bulky, cumbersome, and expensive both to install and operate.

In addition to the use of an adapter for mounting the attachment to the frame, conventionally designed frames may suffer from other drawbacks. For instance, in some cases, conventionally designed frames may not support the mounting of certain configurations of components, for example, a larger than usual engine block and/or a larger than usual powertrain arrangement to be setup onto the frame. Further, a structural integrity of such conventionally designed frames could also be inadequate for supporting operational loads arising from use of the components and attachments that have been mounted onto the frame.

Hence, there is a need for a rear frame for a motor grader that overcomes the aforementioned drawbacks.

SUMMARY OF THE DISCLOSURE

In an aspect of this disclosure, a rear frame for a motor grader includes a pair of arms that are disposed equidistantly from a mid-plane. Each arm has a front portion, a rear portion, and a mid-portion located between the front and rear portions. The front portion of each arm is configured to pivotally couple with a front frame of the motor grader. The rear frame also includes a ripper mounting arrangement, a bumper, and a torque resisting member. The ripper mounting arrangement is located at a rear end of the rear portion of each arm. The bumper is laterally disposed with respect to the mid-plane and rigidly attached to a position on the rear portion of each arm located adjacent the rear end of the rear portion of each arm. The torque resisting member is laterally disposed with respect to the mid-plane and rigidly attached to the mid-portion of each arm.

In another aspect of the present disclosure, a motor grader includes a front frame and a rear frame. The rear frame includes a pair of arms that are disposed equidistantly from a mid-plane. Each arm has a front portion, a rear portion, and a mid-portion located between the front and rear portions. The front portion of each arm is configured to pivotally couple with the front frame. The rear frame also includes a ripper mounting arrangement, a bumper, and a torque resisting member. The ripper mounting arrangement is located at a rear end of the rear portion of each arm. The bumper is laterally disposed with respect to the mid-plane and rigidly attached to a position on the rear portion of each arm located adjacent the rear end of the rear portion of each arm. The torque resisting member is laterally disposed with respect to the mid-plane and rigidly attached to the mid-portion of each arm.

In yet another aspect of the present disclosure, a method for forming a rear frame of a motor grader includes locating a pair of arms equidistantly from a mid-plane of the rear frame, each arm having a front portion, a rear portion, and a mid-portion located between the front and rear portions such that the front portion of each arm would be configured to pivotally couple with a front frame of the motor grader. The method further includes positioning a ripper mounting arrangement at a rear end of the rear portion of each arm. The method also includes positioning a bumper laterally with respect to the mid-plane and rigidly attaching the bumper to a position on the rear portion of each arm located adjacent the rear end of the rear portion of each arm. The method also includes positioning a torque resisting member laterally with respect to the mid-plane and rigidly attaching the torque resisting member to the mid-portion of each arm.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

The present disclosure relates to a motor grader. More particularly, the present disclosure relates to a rear frame of a motor grader.

Figure 1:
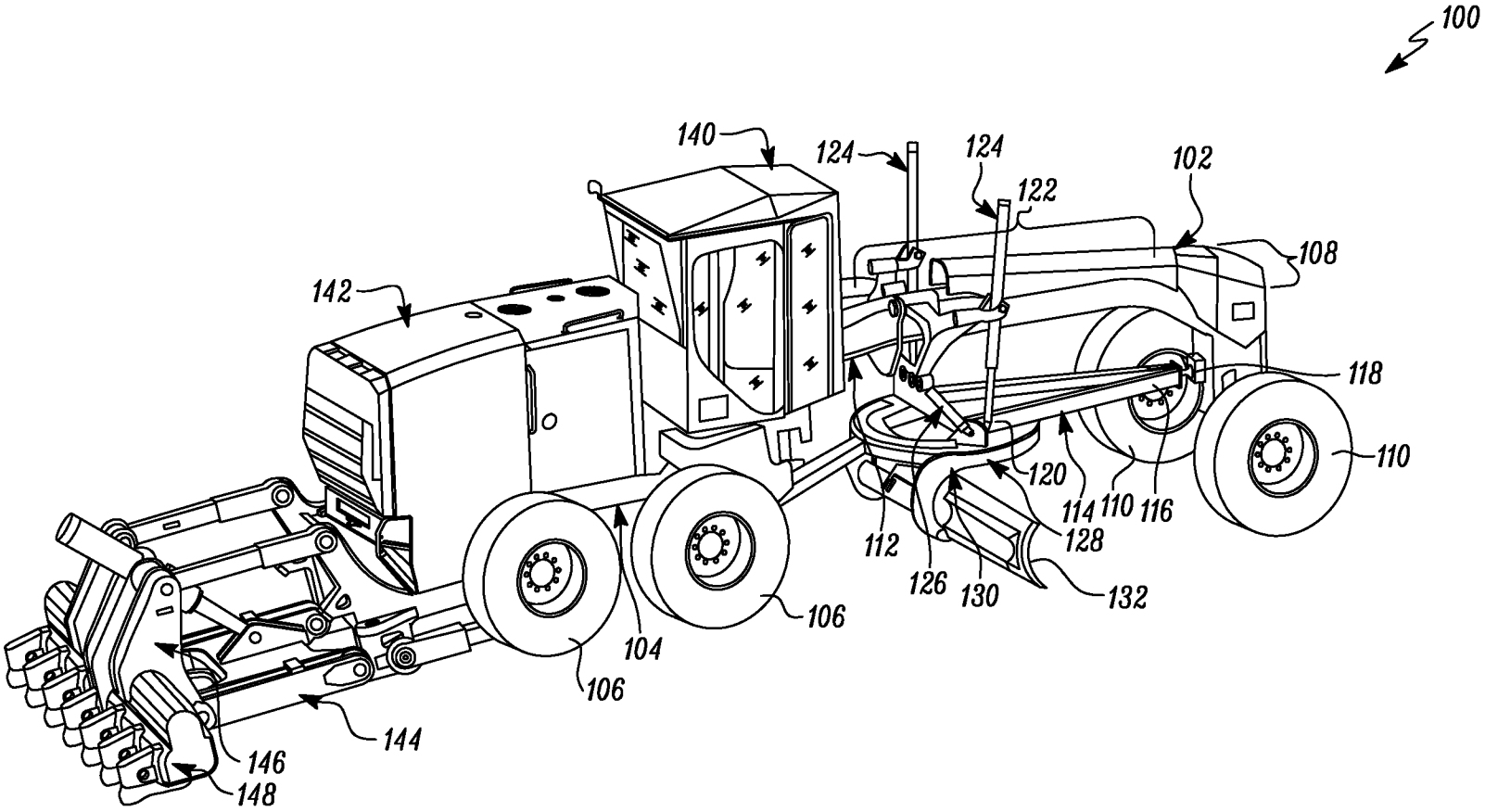
FIG. 1 is a top perspective view of an exemplary motor grader having a front frame, a rear frame, and a ripper assembly mounted to the rear frame in accordance with embodiments of the present disclosure.

FIG. 1 depicts a motor grader 100 in accordance with embodiments of the present disclosure. As shown, the motor grader 100 includes a front frame 102 and a rear frame 104. The rear frame 104 is configured to pivotally support two pair of rear wheels 106 thereon. A fore portion 108 of the front frame 102 rotatably supports a pair of front wheels 110 thereon while a rear portion 112 of the front frame 102 would be pivotally coupled to the rear frame 104 with the help of an articulation joint (not shown) to allow steering of the front frame 102 relative to the rear frame 104.

The motor grader 100 would also include a drawbar 114 having a first end 116 that would be coupled to the fore portion 108 of the front frame 102 with the help of a rotatable joint 118, for example, a ball and socket joint. A second end 120 of the drawbar 114 would be coupled to a mid-portion 122 of the front frame 102 with the help of a pair of lift actuators 124 and a tilt actuator 126. The drawbar 114 would be configured to rotatably support a circle drive gear 128 thereon. A portion 130 of the circle drive gear 128 would be configured to extend downwardly to pivotally support a moldboard 132 thereon.

Figure 2:
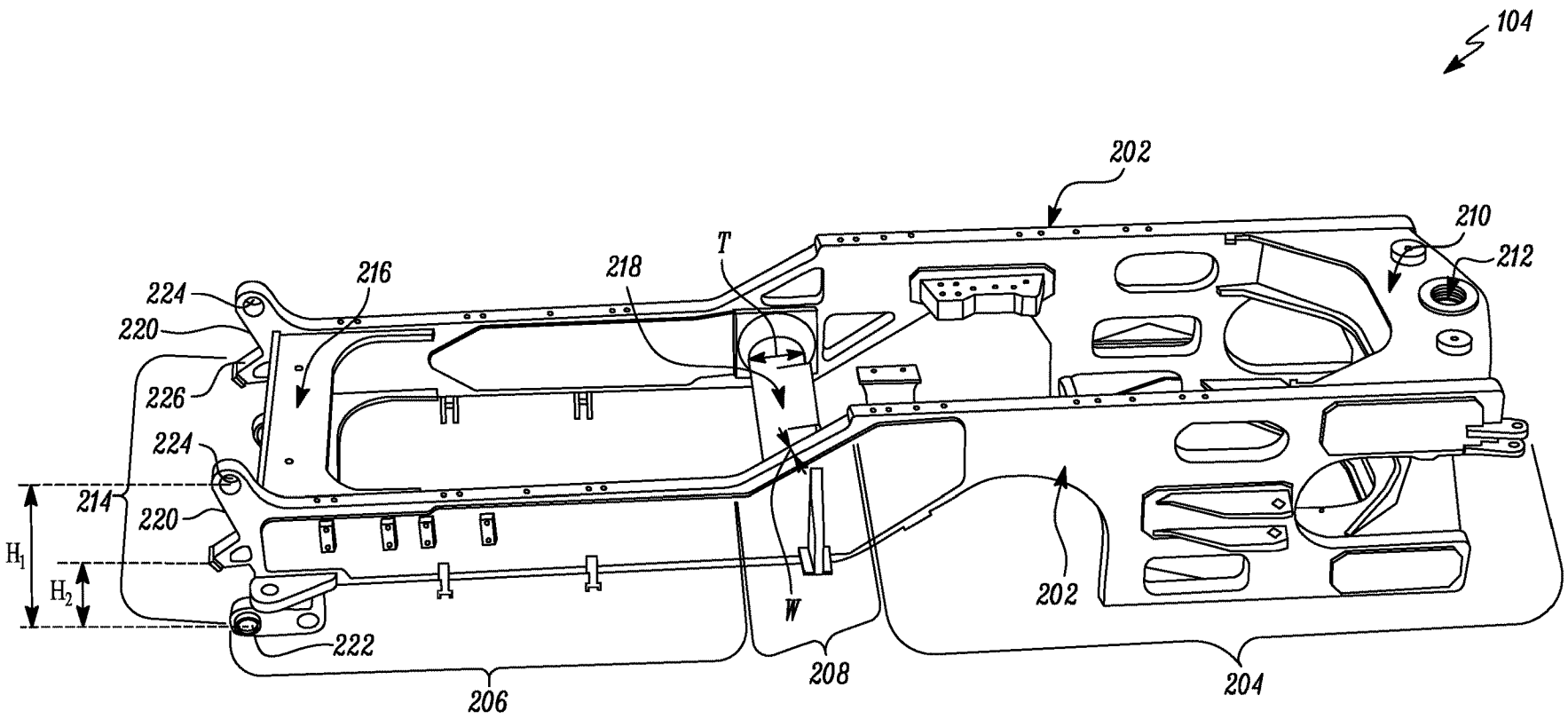
FIG. 2 is a top perspective view of the rear frame in accordance with embodiments of the present disclosure.

As shown in FIG. 2, the rear frame 104 would include a pair of arms 202 that are disposed equidistantly from a mid-plane P. Each arm 202 would have a front portion 204, a rear portion 206, and a mid-portion 208 that would be located between the front and rear portions 204, 206. Moreover, as shown in the illustrated embodiment of FIG. 2, the front portion 204, the rear portion 206, and the mid-portion 208 of each arm 202 would be configured to exhibit a tiered shape.

Referring again to FIG. 1, an operator cab 140 would be disposed on the rear portion 112 of the front frame 102. The operator cab 140 would be configured to house control levers, joysticks, push buttons, and other types of control elements typically known in the art for actuating an operation of the motor grader 100. Moreover, referring to FIGS. 1 and 2, the rear portion 206 of the rear frame 104 would be configured to support a prime mover 142 thereon. The prime mover 142 disclosed herein may be, for example, an engine, a motor, or any other type of prime mover known to persons skilled in the art.

The front portion 204 of each arm 202 would be configured to pivotally couple with the front frame 102. As shown in the illustrated embodiment of FIG. 2, the front portions 204 of the pair of arms 202 would be connected to each other with the help of a hitch member 210. In this embodiment, the hitch member 210 would be configured to form, at least in part, the articulation joint disclosed herein by defining an opening 212 therethrough. This opening 212 would receive a fastener (not shown), for example, a pin, or a bolt for pivotally securing the rear portion 112 of the front frame 102 to the hitch member 210 of the rear frame 104. Although the opening 212 and fastener arrangement is disclosed herein, such an arrangement is merely exemplary in nature, and hence, non-limiting of this disclosure. In other embodiments, other configurations of an articulation joint known to persons skilled in the art may be adopted for implementation in lieu of the opening 212 and fastener arrangement disclosed herein.

Figure 3:
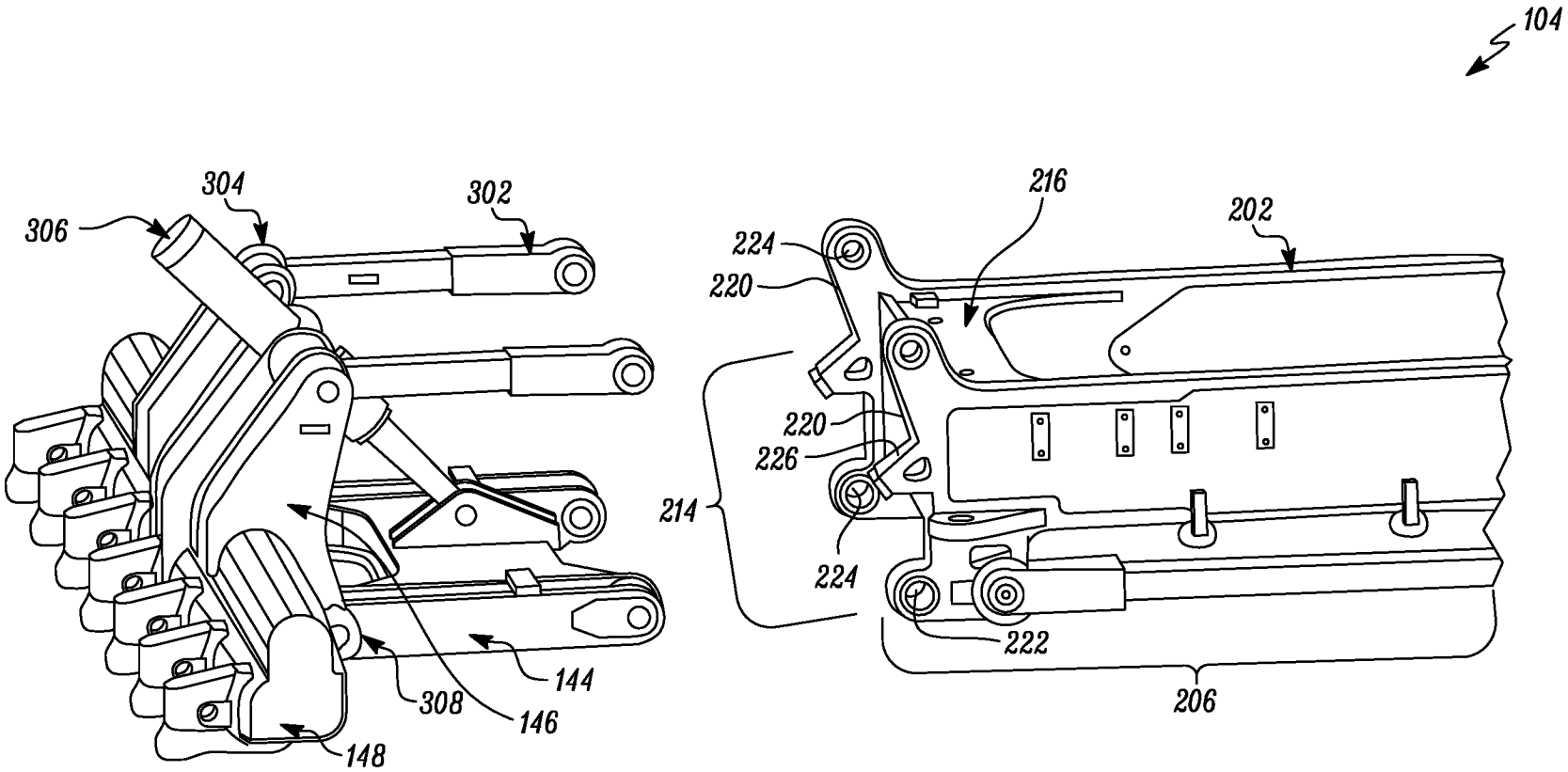
FIGS. 3 and 4 are assembled and exploded top perspective views of the frame and a ripper mounting arrangement used to mount the ripper assembly onto the frame in accordance with embodiments of the present disclosure.

Referring to FIGS. 2-3, the rear frame 104 would also include a ripper mounting arrangement 214, a bumper 216, and a torque resisting member 218. The ripper mounting arrangement 214 would be located at a rear end 220 of the rear portion 206 of each arm 202. In an embodiment as shown in FIG. 2, the ripper mounting arrangement 214 comprises a first hole 222 and a second hole 224 that would be defined in the rear portion 206 of each arm 202 such that the first and second holes 222, 224 of each arm 202 would be disposed transversely to the mid-plane P.

Figure 4:
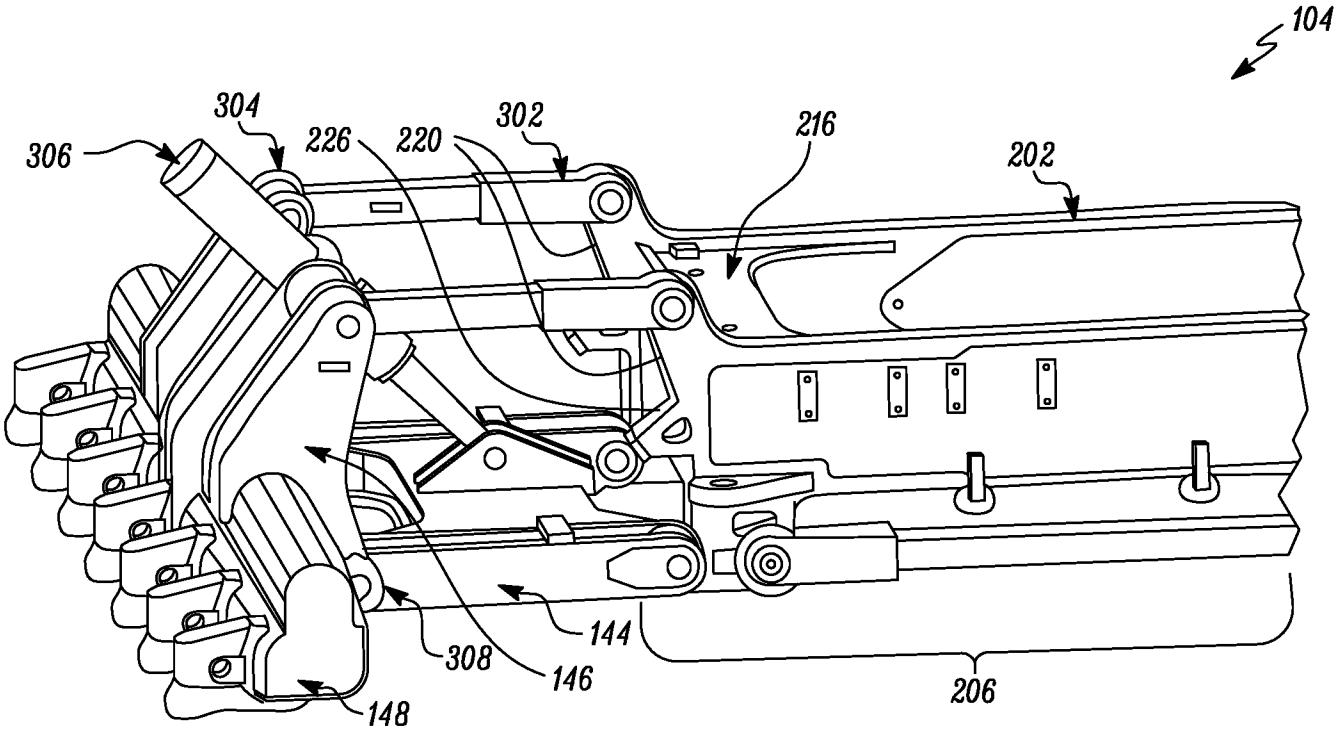

Referring to FIGS. 3-4, the first hole 222 would be configured to allow a pivotal coupling of a primary carriage 144 associated with a ripper assembly 148 to the rear portion 206 of each arm 202. As shown best in the view of FIG. 3, the second hole 224 would be disposed at a height $H_1$ above the first hole 222. Referring to FIGS. 3-4, this second hole 224 from each arm 202 would facilitate a pivotal connection of a floating link rod 302 that pivotally connects to a secondary carriage 146 associated with the ripper assembly 148. It may also be noted that in addition to an upper portion 304 of the secondary carriage 146 being hydraulically actuated in relation to the primary carriage 144 using a hydraulic actuator 306, a lower portion 308 of the secondary carriage 146 would also be pivotally connected to the primary carriage 144.

Referring again to FIGS. 2, 3, and 4, in embodiments herein, the ripper mounting arrangement 214 would also include a stop member 226 extending from the rear portion 206 of each arm 202. This stop member 226 would be located at a height $H_2$ between the first and second holes 222, 224. The stop member 226 is intended to serve as a limit to a range of pivotal movement that the primary carriage 144 can rotatably move in relation to the ripper mounting arrangement 214 of the rear frame 104.

With continued reference to FIGS. 2, 3, and 4, the bumper 216 would be laterally disposed with respect to the mid-plane P and rigidly attached at a position on the rear portion 206 of each arm 202 located adjacent the rear end 220 of the rear portion 206 of the corresponding arm 202. In an embodiment herein, the bumper 216 would be rigidly attached to the rear portion 206 of each arm 202 by welding. However, in other embodiments, the bumper 216 could be rigidly attached to the rear portion 206 of each arm 202 by other means known to persons skilled in the art. For example, the bumper 216 could be rigidly attached to the rear portion 206 of each arm 202 by riveting in lieu of, or in addition to, welding disclosed herein.

As best shown in FIG. 2, the torque resisting member 218 would also be laterally disposed with respect to the mid-plane P and rigidly attached to the mid-portion 208 of each arm 202. Moreover, in an embodiment herein, the torque resisting member 218 would be rigidly attached to the mid-portion 208 of each arm 202 by welding. However, in other embodiments, the torque resisting member 218 could be rigidly attached to the mid-portion 208 of each arm 202 by other means known to persons skilled in the art. For example, the torque resisting member 218 could be rigidly attached to the mid-portion 208 of each arm 202 by riveting in lieu of, or in addition to, welding disclosed herein.

Moreover, in an embodiment herein, a thickness T of the torque resisting member 218 would be selected to correspond with a width W of the mid-portion 208 of each arm 202. It is hereby contemplated that with implementation of the aforementioned embodiment, upon attaching the torque resisting member 218 to the mid-portion 208 of each arm 202, the rear portion 206 of each arm 202 would be configured to support mounting of the prime mover 142 and the ripper assembly 148 vis-à-vis the primary and secondary carriages 144, 146.

Figure 5:
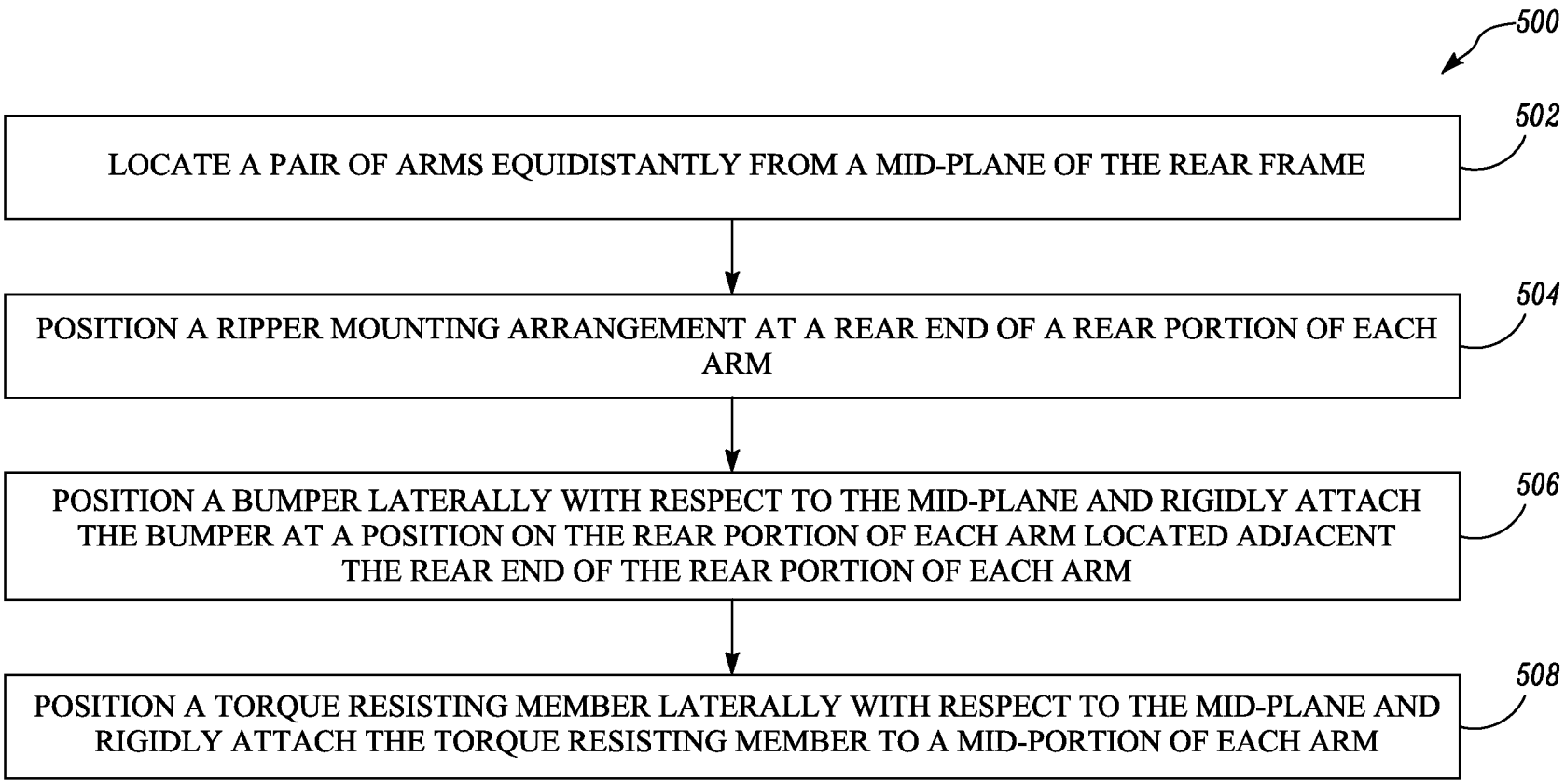
FIG. 5 is a flowchart of a method for forming the rear frame in accordance with embodiments of the present disclosure.

FIG. 5 depicts a flowchart of a method 500 for forming the rear frame 104 in accordance with embodiments of the present disclosure. As shown at step 502, the method 500 includes locating the pair of arms 202 equidistantly from the mid-plane P of the rear frame 104. As disclosed earlier herein, each arm 202 would have the front portion 204, the rear portion 206, and the mid-portion 208 that would be located between the front and rear portions 204, 206 so that the front portion 204 of each arm 202 would be configured to pivotally couple with the front frame 102 of the motor grader 100.

As shown at step 504, the method 500 further includes positioning the ripper mounting arrangement 214 at the rear end 220 of the rear portion 206 of each arm 202. To that effect, in embodiments herein, the method 500 would include defining the first hole 222 in the rear portion 206 of each arm 202 such that the first hole 222 would be disposed transversely to the mid-plane P and configured to allow a pivotal coupling of the primary carriage 144 to the rear portion 206 of each arm 202. In addition, the method 500 would also include defining the second hole 224 in the rear portion 206 of each arm 202 such that the second hole 224 would be disposed transversely to the mid-plane P. As disclosed earlier herein, this second hole 224 would be located at the height $H_1$ above the first hole 222 for facilitating a pivotal connection of the floating link rod 302 pivotally connected to the upper portion 304 of the secondary carriage 146 while the lower portion 308 of the secondary carriage 146 would also be pivotally connected to the primary carriage 144. Additionally, the method 500 would also include providing the stop member 226 such that the stop member 226 would extend from the rear portion 206 of each arm 202 and be located at the height $H_2$ between the first and second holes 222, 224.

As shown at step 506, the method 500 further includes positioning the bumper 216 laterally with respect to the mid-plane P and rigidly attaching the bumper 216 to a position on the rear portion 206 of each arm 202 located adjacent the rear end 220 of the rear portion 206 of the corresponding arm 202. In an embodiment herein, the bumper 216 would be rigidly attached to the rear portion 206 of each arm 202 by welding. However, as disclosed earlier herein, in other embodiments, the bumper 216 could be rigidly attached to the rear portion 206 of each arm 202 by other means known to persons skilled in the art. For example, the bumper 216 could be rigidly attached to the rear portion 206 of each arm 202 by riveting in lieu of, or in addition to, welding disclosed herein.

As shown at step 508, the method 500 further includes positioning the torque resisting member 218 laterally with respect to the mid-plane P and rigidly attaching the torque resisting member 218 to the mid-portion 208 of each arm 202. In an embodiment herein, the torque resisting member 218 would be rigidly attached to the mid-portion 208 of each arm 202 by welding. However, as disclosed herein, in other embodiments, the torque resisting member 218 could be rigidly attached to the mid-portion 208 of each arm 202 by other means known to persons skilled in the art. For example, the torque resisting member 218 could be rigidly attached to the mid-portion 208 of each arm 202 by riveting in lieu of, or in addition to, welding disclosed herein.

Various embodiments disclosed herein are to be taken in the illustrative and explanatory sense and should in no way be construed as limiting of the present disclosure. All joinder references (e.g., mounted, welded, coupled, attached, joined, connected and the like) are only used to aid the reader's understanding of the present disclosure, and may not create limitations, particularly as to the position, orientation, or use of the components disclosed herein. Therefore, joinder references, if any, are to be construed broadly. Moreover, such joinder references do not necessarily infer that two elements are directly connected to each other.

Additionally, all positional terms, such as, but not limited to, "fore", "aft", "front", "rear", "first", "second", "primary", "secondary" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element relative to, or over, another element.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional components, such features may be omitted from the scope of the present disclosure without departing from the spirit of the present disclosure as defined in the appended claims.

INDUSTRIAL APPLICABILITY

The present disclosure has applicability for use in reducing a number of parts that were previously required for mounting an attachment, such as the ripper assembly 148, to a frame of a motor grader. Implementation of the present disclosure renders the rear frame 104 of such a configuration that allows the rear frame 104 to establish a direct connection with the primary carriage 144 and the secondary carriage 146 associated with the ripper assembly 148 without the need for additional components, such as an adapter, that were previously used in traditional mounting attachments onto motor graders. By eliminating the need for adapters, the present disclosure allows manufacturers and users of motor graders to consequently eliminate additional weight that was previously borne by the frame when mounted with the adapter.

It is hereby contemplated that with absence of the additional weight now associated with omission of the adapter, an amount of fuel consumption by the prime mover 142 of the motor grader 100 may decrease thereby improving profitability associated with operation of the machine. Therefore, the present disclosure offers a cost-effective, easy, and relatively quick manner of installing and operating the ripper assembly 148 as compared to previously known techniques of installing and operating ripper assemblies.

In addition, by attaching the bumper 216 and the torque resisting member 218 to the rear portion 206 and the mid-portion 208 of the rear frame 104 respectively, it is envisioned that the rear frame 104 would be imparted with a sturdy and robust configuration that would allow the rear frame 104 to support the loads associated with the mounted components and attachments as well as the loads encountered during operation of such mounted components and attachments. For instance, by positioning the bumper 216 to be located adjacent to the rear end 220 of the rear frame 104 and the torque resisting member 218 at the mid-portion 208 of the rear frame 104, the rear portion 206 of the rear frame 104 can also support a retrofit mounting of a relatively large prime mover and/or powertrain arrangement thereon. In addition, by positioning the torque resisting member 218 to be located at the mid-portion 208 of the rear frame 104, the torque resisting member 218 would now be able to effectively provide a maximum amount of resistance to a moment of forces that may be incident on the pair of arms 202 and acting about the mid-plane P during operation of the motor grader 100.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A rear frame for a motor grader, the rear frame comprising:

a pair of arms disposed equidistantly from a mid-plane, each arm having a front portion, a rear portion, and a mid-portion located between the front and rear portions, the front portion of each arm configured to pivotally couple with a front frame of the motor grader;

a ripper mounting arrangement located at a rear end of the rear portion of each arm;

a bumper laterally disposed with respect to the mid-plane and rigidly attached to a position on the rear portion of each arm located adjacent the rear end of the rear portion of each arm; and a torque resisting member laterally disposed with respect to the mid-plane and rigidly attached to the mid-portion of each arm.

2. The rear frame of claim 1, wherein the ripper mounting arrangement comprises:

a first hole defined in the rear portion of each arm and disposed transversely to the mid-plane, the first hole configured to allow a pivotal coupling of a primary carriage to the rear portion of each arm;

a second hole defined in the rear portion of each arm and disposed transversely to the mid-plane, the second hole disposed at a height above the first hole for facilitating a pivotal connection of a floating link rod pivotally connected to a secondary carriage; wherein a lower portion of the secondary carriage is pivotally connected to the primary carriage.

3. The rear frame of claim 2, wherein the ripper mounting arrangement comprises:

a stop member extending from the rear portion of each arm and located at a height between the first and second holes.

4. The rear frame of claim 1, wherein the bumper is rigidly attached to the rear portion of each arm by welding.

5. The rear frame of claim 1, wherein the front portion, the rear portion, and the mid-portion of each arm are configured to exhibit a tiered shape.

6. The rear frame of claim 1, wherein the torque resisting member is rigidly attached to the mid-portion of each arm by welding.

7. The rear frame of claim 1, wherein a thickness of the torque resisting member corresponds to a width of the mid-portion of each arm.

8. The rear frame of claim 2, wherein upon attaching the torque resisting member to the mid-portion of each arm, the rear portion of each arm is configured to support mounting of a prime mover and a ripper assembly via the primary and secondary carriages.

9. A motor grader comprising:

a front frame;

a rear frame having:

a pair of arms disposed equidistantly from a mid-plane, each arm having a front portion, a rear portion, and a mid-portion located between the front and rear portions, the front portion of each arm configured to pivotally couple with the front frame of the motor grader;

a ripper mounting arrangement located at a rear end of the rear portion of each arm;

a bumper laterally disposed with respect to the mid-plane and rigidly attached to a position on the rear portion of each arm located adjacent the rear end of the rear portion of each arm; and a torque resisting member laterally disposed with respect to the mid-plane and rigidly attached to the mid-portion of each arm.

10. The motor grader of claim 9, wherein the ripper mounting arrangement comprises:

a first hole defined in the rear portion of each arm and disposed transversely to the mid-plane, the first hole configured to allow a pivotal coupling of a primary carriage to the rear portion of each arm;

a second hole defined in the rear portion of each arm and disposed transversely to the mid-plane, the second hole disposed at a height above the first hole for facilitating a pivotal connection of a floating link rod pivotally connected to a secondary carriage; wherein a lower portion of the secondary carriage is pivotally connected to the primary carriage.

11. The motor grader of claim 10, wherein the ripper mounting arrangement comprises:

a stop member extending from the rear portion of each arm and located at a height between the first and second holes.

12. The motor grader of claim 9, wherein the bumper is rigidly attached to the rear portion of each arm by welding.

13. The motor grader of claim 9, wherein the front portion, the rear portion, and the mid-portion of each arm are configured to exhibit a tiered shape.

14. The motor grader of claim 9, wherein the torque resisting member is rigidly attached to the mid-portion of each arm by welding.

15. The motor grader of claim 9, wherein a thickness of the torque resisting member corresponds to a width of the mid-portion of each arm.

16. A method for forming a rear frame of a motor grader, the method comprising:

locating a pair of arms equidistantly from a mid-plane of the rear frame, each arm having a front portion, a rear portion, and a mid-portion located between the front and rear portions, the front portion of each arm configured to pivotally couple with a front frame of the motor grader;

positioning a ripper mounting arrangement at a rear end of the rear portion of each arm;

positioning a bumper laterally with respect to the mid-plane and rigidly attaching the bumper to a position on the rear portion of each arm located adjacent the rear end of the rear portion of each arm; and positioning a torque resisting member laterally with respect to the mid-plane and rigidly attaching the torque resisting member to the mid-portion of each arm.

17. The method of claim 16 further comprising defining:

a first hole in the rear portion of each arm such that the first hole is disposed transversely to the mid-plane and configured to allow a pivotal coupling of a primary carriage to the rear portion of each arm; and a second hole in the rear portion of each arm such that the second hole is disposed transversely to the mid-plane and located at a height above the first hole for facilitating a pivotal connection of a floating link rod pivotally connected to a secondary carriage, wherein a lower portion of the secondary carriage is pivotally connected to the primary carriage.

18. The method of claim 17 further comprising providing a stop member extending from the rear portion of each arm and located at a height between the first and second holes.

19. The method of claim 16, wherein the bumper is rigidly attached to the rear portion of each arm by welding.

20. The method of claim 16, wherein the torque resisting member is rigidly attached to the mid-portion of each arm by welding.

* * * * *